US006273047B1

(12) United States Patent
Yoshikawa et al.

(10) Patent No.: US 6,273,047 B1
(45) Date of Patent: Aug. 14, 2001

(54) FOUR-STROKE ENGINE

(75) Inventors: Masaaki Yoshikawa; Hironao Takahashi, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/648,834

(22) Filed: Aug. 25, 2000

(30) Foreign Application Priority Data

Sep. 24, 1999 (JP) ..... 11-270377
Sep. 24, 1999 (JP) ..... 11-270378

(51) Int. Cl.[7] ..... F01L 1/26
(52) U.S. Cl. ..... 123/184.42; 123/184.47
(58) Field of Search ..... 123/184.24, 184.42, 123/184.47

(56) References Cited

U.S. PATENT DOCUMENTS 4,760,703 * 8/1988 Minami et al. ..... 123/184.42
4,821,826 * 4/1989 Lings ..... 123/184.24
5,050,701 * 9/1991 Okui et al. ..... 123/184.42
6,026,775 * 2/2000 Yamane ..... 123/184.24
6,142,114 * 11/2000 Yoshikawa ..... 123/184.42

* cited by examiner

*Primary Examiner*—Marguerite McMahon
(74) *Attorney, Agent, or Firm*—Ernest A. Beutler

(57) ABSTRACT

A compact small displacement automotive internal combustion engine that has its cylinder bores inclined to the vertical and that has a reentrant configured induction system that provides long intake runners while maintaining an engine that has its longitudinal width in the engine compartment substantially equal to its vertical height. In addition the engine has an improved accessory mounting arrangement.

7 Claims, 3 Drawing Sheets

FOUR-STROKE ENGINE

BACKGROUND OF THE INVENTION

This invention relates to a four-stroke engine and more particularly to an engine having a very compact construction and high specific output for use in powering motor vehicles and particularly automotive type motor vehicles.

There is obviously a demand for compact power plants for motor vehicles such as automobiles and particularly compact, high output, four-cycle internal combustion engines. This demand is particularly evident when the engine is positioned in the motor vehicle in a transverse relationship. Because of the limited space available, the engine should be kept as compact as possible and nevertheless the components should be readily accessible.

In addition to the engine per se, frequently there are accessories for the engine and it is also desirable that these accessories be driven from the engine in a compact manner and without interfering with the serviceability of each other.

In motor vehicle applications, the engine is usually operated at a lower speed than other applications such as with motorcycles. In order to obtain the desired engine output, it is necessary to have a fairly long inlet system for the engine. This further adds to the difficulties in providing a compact four-cycle engine.

It is, therefore, an object to this invention to provide an extremely compact, high output, internal combustion engine that can be utilized for automotive applications.

It is a further object to this invention to provide an engine having such a compact construction and also incorporating a relatively long induction system to improve engine performance.

It is a yet further object to this invention to provide an improved layout for an internal combustion engine.

As has been noted, many times accessories must be driven from the engine and these accessories should be mounted to the engine in a manner that facilitates their servicing and their driving. With a small engine, the accessories utilized are relatively large in relation to the engine size. This makes the mounting of them in a rigid manner quite difficult.

It is, therefore, a still further object to this invention to provide an improved accessory mounting arrangement for a compact internal combustion engine.

SUMMARY OF THE INVENTION

A first feature of this invention is adapted to be embodied in a compact, four-cycle internal combustion engine having a plurality of cylinder bores with their axes parallel and lying in a common plane. One side of the engine serves as an intake side while the other side serves as an exhaust side. The engine is inclined to the vertical toward the exhaust side of the engine. An intake manifold is affixed to the intake side of the engine and has a curvilinear shape so as to terminate at a plenum chamber that is disposed at the upward facing side of the engine. The plenum chamber has an inlet for the induction of an air charge. In accordance with the invention, the longitudinal width of the total engine package is substantially equal to its height.

In accordance with another feature of the invention, the engine includes a cylinder head, cylinder block, crankcase member and oil pan connected to each other. The cylinder block and oil pan define mounting bosses to which engine accessories may be attached.

DETAILED DESCRIPTION OF THE PREFERRED EMBODIMENT OF THE INVENTION

Figure 1:
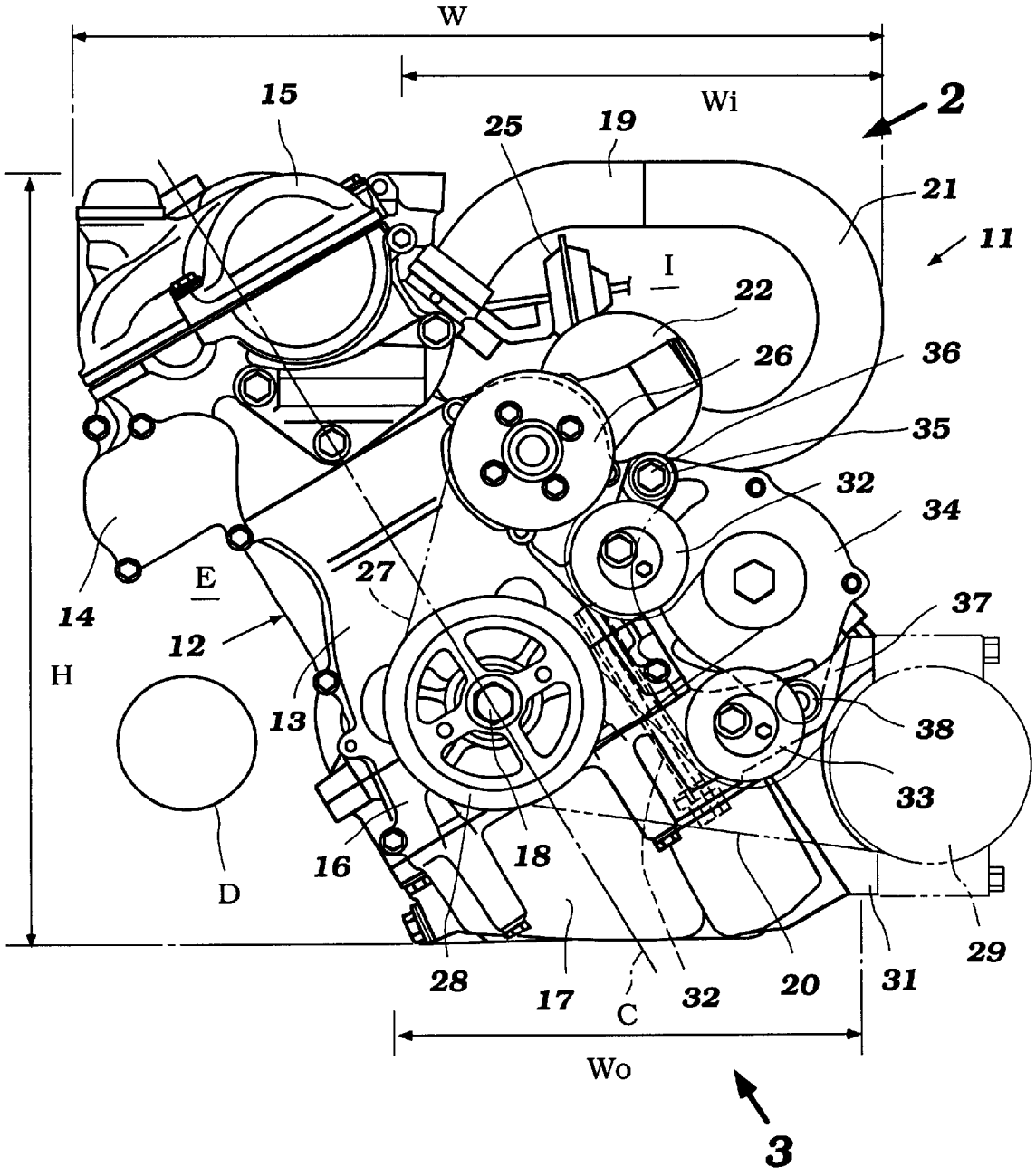
FIG. 1 is a front elevational view of an internal combustion engine constructed in accordance with an embodiment of the invention.
Figure 2:
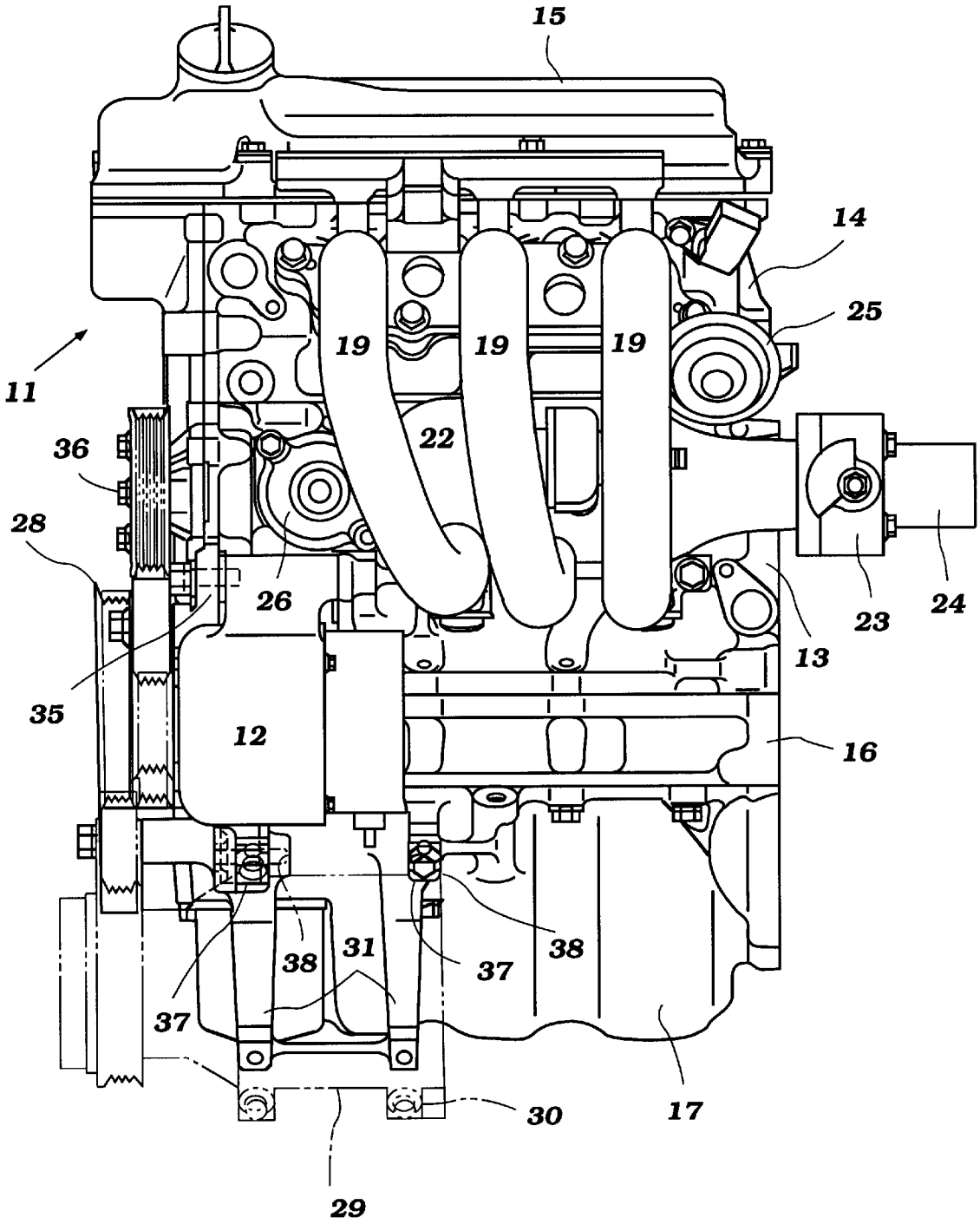
FIG. 2 is a side view looking in the direction of the arrow 2 in FIG. 1.
Figure 3:
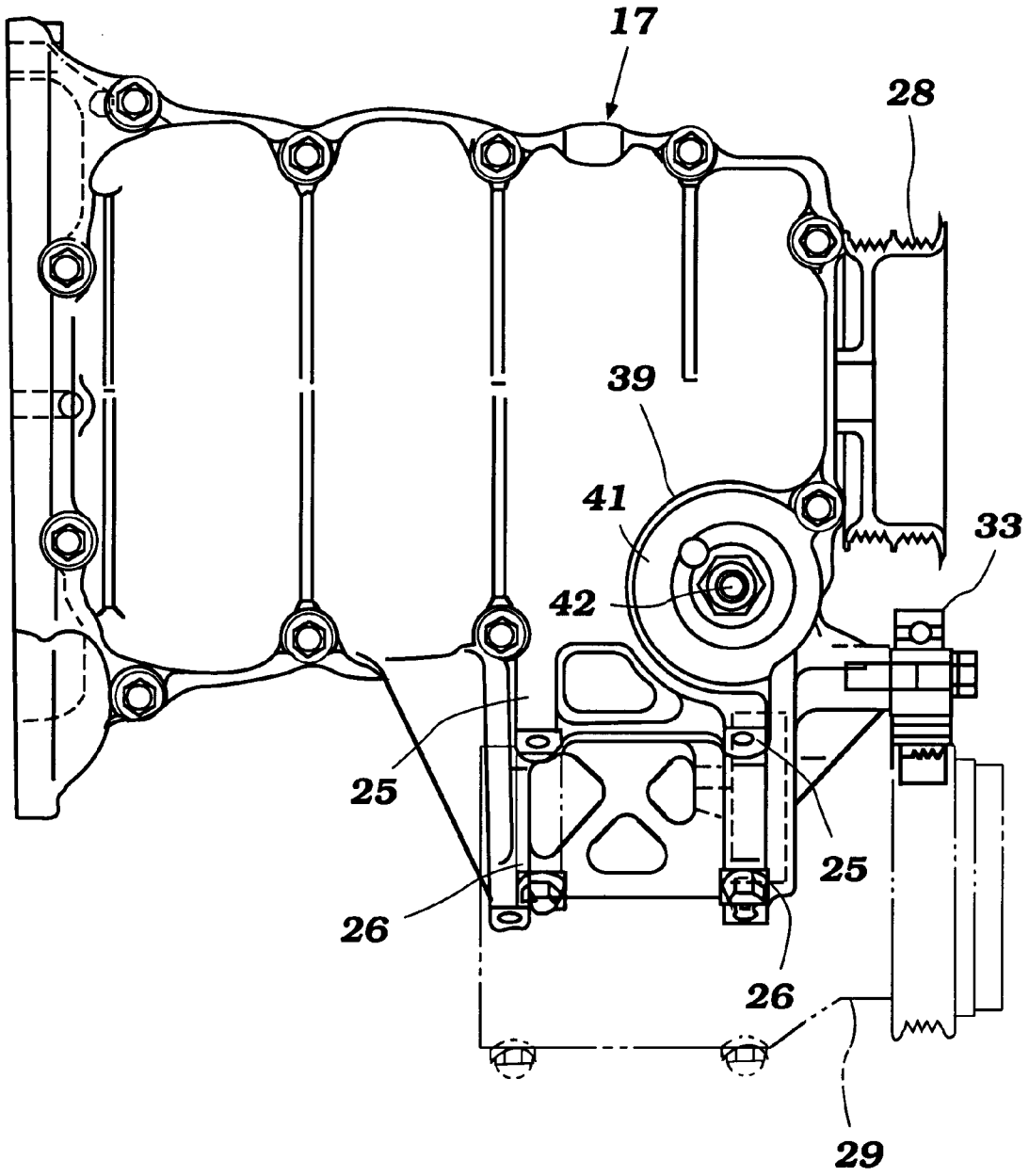
FIG. 3 is a view of the engine looking in the direction of the arrow 3 in FIG. 1.

In the drawings, the reference numeral 11 indicates generally an internal combustion engine constructed in accordance with an embodiment of the invention. In the illustrated embodiment, the engine 11 is of the three-cylinder inline type although it will be apparent to those skilled in the art how the invention can be utilized with engines having other cylinder numbers. The invention does have particularly utility, however, in compact small engines intended for automotive application. This is because of the compact nature of the engine 11, as will become apparent as this description proceeds.

The engine 11 is designed so as to be primarily embodied in a transverse engine, automotive application such as a front engine, front wheel drive arrangement wherein the driving axles of the vehicle are indicated at D in FIG. 1.

The engine 11 includes a body assembly 12 that is comprised primarily of a cylinder block 13, a cylinder head assembly 14 to which is secured a cam cover 15. Affixed to the underside of the cylinder block 13 is a crankcase member 16 from which an oil pan 17 depends.

The cylinder block 13 defines three cylinder bores that are disposed in an inline relationship with their axes lying generally on a line indicated at C. As installed in the vehicle, this axis is inclined from the vertical rearwardly toward the axis of the drive shafts D so as to provide a compact construction, as will become apparent. Because of the transverse positioning of the engine 11 in the engine compartment, the front of the engine shown in FIG. 1 actually is disposed at one side of the vehicle body.

Although the internal construction of the engine is not particularly important in understanding the invention, the cylinder block 13 defines the aforenoted cylinder bores and pistons reciprocate in these cylinder bores. The pistons, in turn, drive a crankshaft 18 through connecting rods in a manner that is well known. The crankshaft 18 is journalled between the cylinder block 13 and the crankcase member 16 by any suitable type of bearing arrangement.

The cylinder head assembly 14 is provided with a suitable valve mechanism, which may include, for example, a pair of twin overhead camshafts that operate intake and exhaust valves disposed on opposite sides of the cylinder head assembly 14 in any suitable manner. Of course, the features of the invention can be utilized in conjunction with engines having only a single overhead camshaft or, for that matter, pushrod operated overhead valves. The front side of the engine and that which faces generally upwardly in the vehicle is considered the intake side and this is identified by the reference character I.

An induction system, indicated generally by the reference numeral 19, cooperates with this intake side of the engine so as to deliver a charge to it. The intake system 19 includes manifold runners that extend upwardly from mating surfaces of the cylinder head member 14 where they communicate with the intake ports of the engine. The runners then curve generally in a horizontal direction toward the front of the vehicle to terminate in reentrant sections 21 which then curve backwardly toward the cylinder block 13 where they merge into a plenum chamber 22 that extends longitudinally of the engine 11 along the upper side of the cylinder block 13.

A throttle body 23 at one end of this plenum chamber 22 communicates with an air inlet device through an inlet tube 24 which air inlet device may include, for example, an air silencer and filter assembly. It should be noted that this curved configuration of the manifold runners 19 permits a relatively long induction system while maintaining a relatively short length in the actual engine compartment with the actual longitudinal length of the entire intake system being indicated by the dimensions WI, which is substantially greater than one-half of the overall, longitudinal engine width in this direction, indicated at W.

A suitable charge forming system may be provided for the engine and this may include either carburetors or fuel injectors that inject directly into the combustion chambers or into the induction system at some suitable location.

In order to improve the induction efficiency at low speeds and low loads, the engine may also be provided with a swirl or tumble control system that includes a tumble control valve actuator, indicated generally at 25 and which operates a tumble control or swirl control valve so as to improve combustion under lower and mid-range conditions.

The opposite side or rear side of the engine considering it in the engine compartment is the exhaust side and this is indicated at E. A suitable exhaust system (not shown) is provided for collecting the exhaust gases from the combustion chambers and discharging them to the atmosphere in any suitable manner.

Because of the inclined nature of the engine 11, its lower base has a relatively narrow footprint WO that is approximately equal to or slightly less than the longitudinal length WI of the intake system in the engine compartment. Also, the height of the engine 11 indicated by the dimension H is substantially equal to the width W in the longitudinal direction in the engine compartment and hence, the engine 11 provides a very compact package.

An accessory drive system is provided for driving certain accessories associated with the engine and this accessory drive system operates a water pump 26 for the liquid cooling system of the engine. The water pump 26 is driven by a drive belt 27 from a crankshaft mounted pulley 28.

The drive belt 27 also may drive another engine accessory such as an air conditioning compressor 29 which can be an optional accessory for the engine 11 and which is mounted on a mounting boss 31 formed on the front of the oil pan 17. If such an accessory is employed, it can be driven by the drive belt 27 and pair of tensioner pulleys 32 and 33 are mounted on the cylinder block 13 and oil pan 17 in a suitable manner so as to provide a serpentine path for the drive belt 27 to continue to maintain the compactness of the engine.

Also, an alternator indicated generally by the reference numeral 34 is driven by the drive belt 27 and it is mounted in a rigid manner on the engine by means of a first mounting boss 35 formed on the cylinder block 13 and to which it is affixed by a fastener 36. A pair of second mounting bosses 37 are formed on the oil pan member 17 and the alternator 34 is connected to them by a further fasteners 38.

In order to further simply the construction and to provide an easily serviced engine, the oil pan member 17 is formed with a recess 39 in which an oil filter 41 is adapted to be mounted on a post 42 that supplies oil to the interior of the filter and then returns it back to the engine lubricating system in a manner well known in the art.

Thus, from the foregoing description it should be readily apparent that the described construction provides a very compact engine and one in which accessories can be conveniently mounted on the engine body in a rigid manner. Of course, the foregoing description is that of a preferred embodiment of the invention and various modifications and changes may be made without departing from the spirit and scope of the invention, as defined by the appended claims.

What is claimed is:

1. A compact, four-cycle internal combustion engine having a plurality of cylinder bores with their axes parallel and lying in a common plane, one side of said engine serving as an intake side and the other side of said engine serving as an exhaust side, said engine being inclined to the vertical toward said exhaust side, an intake manifold affixed to said intake side of said engine and having a curvilinear shape so as to terminate at a plenum chamber that is disposed in proximity to an upward facing side of said engine, said plenum chamber having an inlet for the induction of an air charge, the longitudinal width of said engine being substantially equal to its height.

2. A compact, four-cycle internal combustion engine as set forth in claim 1 wherein the longitudinal width of the induction system is at least one half of the longitudinal width of said engine.

3. A compact, four-cycle internal combustion engine as set forth in claim 2 wherein the effective length of the induction system is substantially greater than its longitudinal width.

4. A compact, four-cycle internal combustion engine as set forth in claim 2 wherein the longitudinal width of the of the induction system is substantially equal to the longitudinal width of the lower surface of said engine.

5. A compact, four-cycle internal combustion engine as set forth in claim 4 wherein the effective length of the induction system is substantially greater than its longitudinal width.

6. A compact, four-cycle internal combustion engine as set forth in claim 5 wherein engine includes a cylinder head, a cylinder block in which the cylinder bores are formed, a crankcase member and an oil pan connected to each other, said cylinder block and oil pan define mounting bosses to which at least one engine accessory is attached.

7. A compact, four-cycle internal combustion engine as set forth in claim 6 wherein oil pan further has a front face adapted to mount another engine accessory.

* * * * *